US011655989B2

(12) United States Patent
Oikawa et al.

(10) Patent No.: US 11,655,989 B2
(45) Date of Patent: May 23, 2023

(54) OUTDOOR UNIT OF AIR-CONDITIONING APPARATUS

(71) Applicant: Mitsubishi Electric Corporation, Tokyo (JP)

(72) Inventors: Kyonosuke Oikawa, Tokyo (JP); Yo Kitabatake, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 111 days.

(21) Appl. No.: 17/429,963

(22) PCT Filed: Apr. 9, 2019

(86) PCT No.: PCT/JP2019/015462

§ 371 (c)(1),
(2) Date: Aug. 11, 2021

(87) PCT Pub. No.: WO2020/208707

PCT Pub. Date: Oct. 15, 2020

(65) Prior Publication Data

US 2022/0136714 A1 May 5, 2022

(51) Int. Cl.
*F24F 1/36* (2011.01)

(52) U.S. Cl.
CPC ..... *F24F 1/36* (2013.01)

(58) Field of Classification Search
CPC ..... F24F 1/36; F24F 1/20; F24F 1/22; F24F 2221/52
See application file for complete search history.

(56) References Cited

U.S. PATENT DOCUMENTS

2003/0042010 A1* 3/2003 Kobayashi ..... F24F 13/20 165/122
2017/0248328 A1* 8/2017 Eskew ..... F24F 1/22

FOREIGN PATENT DOCUMENTS

JP H09-026164 A 1/1997
JP H09-178222 A 7/1997
(Continued)

OTHER PUBLICATIONS

Examination Report dated May 20, 2022 issued in corresponding AU Patent Application No. 2019445314.
(Continued)

*Primary Examiner* — Cassey D Bauer
(74) *Attorney, Agent, or Firm* — Posz Law Group, PLC

(57) ABSTRACT

An outdoor unit of an air-conditioning apparatus includes: a housing; and a partition plate, a device accommodated in a machine chamber, a fan accommodated in a fan chamber, the partition plate having a wiring passage, wherein the outdoor unit includes a water receiving part provided to the machine chamber, the water receiving part having a box shape, a side wall portion of the water receiving part has a first opening port, and an upper surface portion of the water receiving part has a second opening port, the water receiving part is attached to the partition plate such that an edge of the first opening port is in contact with the partition plate, a gap, through which water discharged by the water receiving part passes, is formed between a bottom portion of the water receiving part and the partition plate, the bottom portion being inclined toward the gap.

8 Claims, 6 Drawing Sheets

(56) References Cited

FOREIGN PATENT DOCUMENTS

| | | | |
|---|---|---|---|
| JP | 2006-046830 | A | 2/2006 |
| KR | 2011-0023162 | A | 3/2011 |

OTHER PUBLICATIONS

International Search Report dated Jul. 2, 2019, issued in corresponding International Patent Application No. PCT/JP2019/015462 (and English Machine Translation).

* cited by examiner

OUTDOOR UNIT OF AIR-CONDITIONING APPARATUS

CROSS REFERENCE TO RELATED APPLICATION

This application is a U.S. National Stage Application of International Application No. PCT/JP2019/015462, filed on Apr. 9, 2019, the contents of which are incorporated herein by reference.

TECHNICAL FIELD

The present disclosure relates to an outdoor unit of an air-conditioning apparatus in which it is possible to prevent adhesion of water to a device accommodated in a machine chamber.

BACKGROUND ART

The outdoor unit of an air-conditioning apparatus includes a housing. The inside of the housing is partitioned into a fan chamber and a machine chamber by a partition plate. A fan and a heat exchanger are accommodated in the fan chamber. An electric component box is accommodated in an upper portion of the machine chamber, electric parts, such as a control board, being accommodated in the electric component box. A device to be energized, such as a compressor, is also accommodated in the machine chamber at a position below the electric component box. To energize the fan, the fan is connected with the electric part in the electric component box by a wiring. As described above, the fan is accommodated in the fan chamber, and the electric component box is accommodated in the machine chamber. Therefore, the partition plate, which partitions the inside of the housing into the fan chamber and the machine chamber, has a through hole or a groove as a wiring passage through which a wiring connected to the fan passes.

An air outlet is formed at a portion of the housing, the portion forming the fan chamber, to blow out air suctioned into the fan chamber by the fan to the outside of the fan chamber. Therefore, water, such as rain, intrudes into the fan chamber from the air outlet. Accordingly, there is a possibility that water having intruded into the fan chamber intrudes into the machine chamber through the wiring passage formed in the partition plate, and the water adheres to the device accommodated in the machine chamber.

In view of the above, hitherto, for an outdoor unit of an air-conditioning apparatus, an outdoor unit has been proposed in which it is possible to prevent water having intruded into a machine chamber from intruding into an electric component box from a wiring passage of a partition plate (see Patent Literature 1). Specifically, in the outdoor unit described in Patent Literature 1, a groove that forms a wiring passage is formed at the upper portion of the partition plate. Further, the electric component box of the outdoor unit described in Patent Literature 1 includes a support portion that supports a wiring connected with a fan, and a pressing piece that presses the wiring connected with the fan from above. The support portion and the pressing piece hold the wiring connected with the fan such that the wiring connected with the fan is inserted into the electric component box while extending obliquely upward. With such a configuration, in the machine chamber, a curved portion that is curved to protrude downward is formed in the wiring, connected with the fan, at a position between the wiring passage of the partition plate and the electric component box. Therefore, in the outdoor unit described in Patent Literature 1, when water having intruded into the machine chamber from the wiring passage of the partition plate flows along the wiring connected with the fan, the water collects at a curved portion, and drips off at the curved portion. Accordingly, in the outdoor unit described in Patent Literature 1, it is possible to prevent water having intruded into the machine chamber from the wiring passage of the partition plate from intruding into the electric component box.

CITATION LIST

Patent Literature

Patent Literature 1: Japanese Unexamined Patent Application Publication No. 9-26164

SUMMARY OF INVENTION

Technical Problem

A device to be energized, such as a compressor, is also accommodated in the machine chamber of the outdoor unit of the air-conditioning apparatus at a position below the electric component box. Therefore, the outdoor unit described in Patent Literature 1 has a problem that water dripped from the curved portion of the wiring connected with the fan adheres to the device to be energized that is provided below the electric component box.

The present disclosure has been made to solve the above-mentioned problem, and an object thereof is to provide an outdoor unit of an air-conditioning apparatus in which it is possible to prevent adhesion of water having intruded into the machine chamber from the wiring passage of the partition plate to a device to be energized that is provided below the electric component box more effectively than the related-art technology.

Solution to Problem

An outdoor unit of an air-conditioning apparatus according to an embodiment of the present disclosure includes: a housing; and a partition plate including a body portion configured to partition an inside of the housing into a machine chamber and a fan chamber, a device to be energized being accommodated in the machine chamber, a fan being accommodated in the fan chamber, the body portion of the partition plate having a wiring passage through which a wiring connected with the fan passes, wherein the outdoor unit includes a water receiving part provided to the machine chamber, with a side wall portion of the water receiving part facing the wiring passage, to receive water intruding into the machine chamber from the wiring passage, the water receiving part having a box shape, the side wall portion of the water receiving part has a first opening port at a portion that faces the wiring passage, and an upper surface portion of the water receiving part has a second opening port through which the wiring drawn from the water receiving part passes, the water receiving part is attached to the partition plate such that a peripheral edge of the first opening port is brought into contact with the body portion, a gap is formed between a portion of a bottom portion of the water receiving part and the partition plate, water received by the water receiving part passing through the gap when discharged from the water receiving part, and the bottom portion is inclined toward the gap.

Advantageous Effects of Invention

In the outdoor unit of the air-conditioning apparatus according to an embodiment of the present disclosure, water having intruded into the machine chamber from the wiring passage of the partition plate is received by the water receiving part. In the outdoor unit of the air-conditioning apparatus according to the present disclosure, water received by the water receiving part flows downward along the partition plate. Therefore, in the outdoor unit of the air-conditioning apparatus according to the present disclosure, it is possible to prevent adhesion of water to a device to be energized that is provided below the electric component box.

DESCRIPTION OF EMBODIMENT

Embodiment

Figure 1:
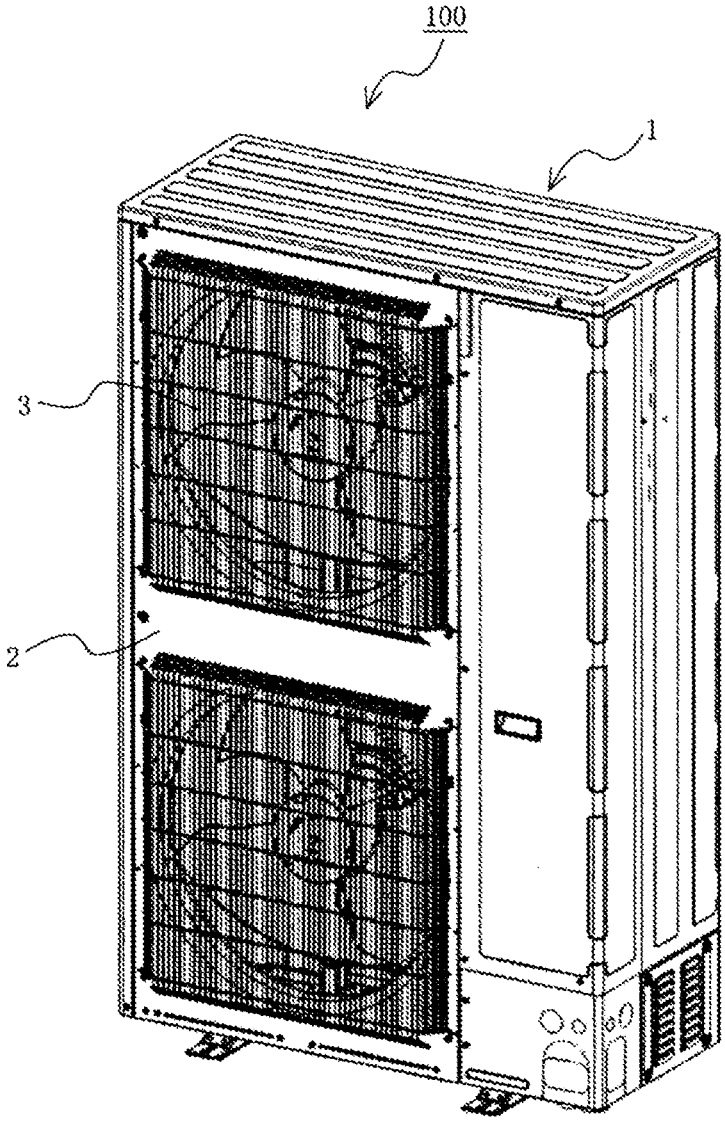
FIG. 1 is a perspective view showing an external appearance of an outdoor unit of an air-conditioning apparatus according to Embodiment.
Figure 2:
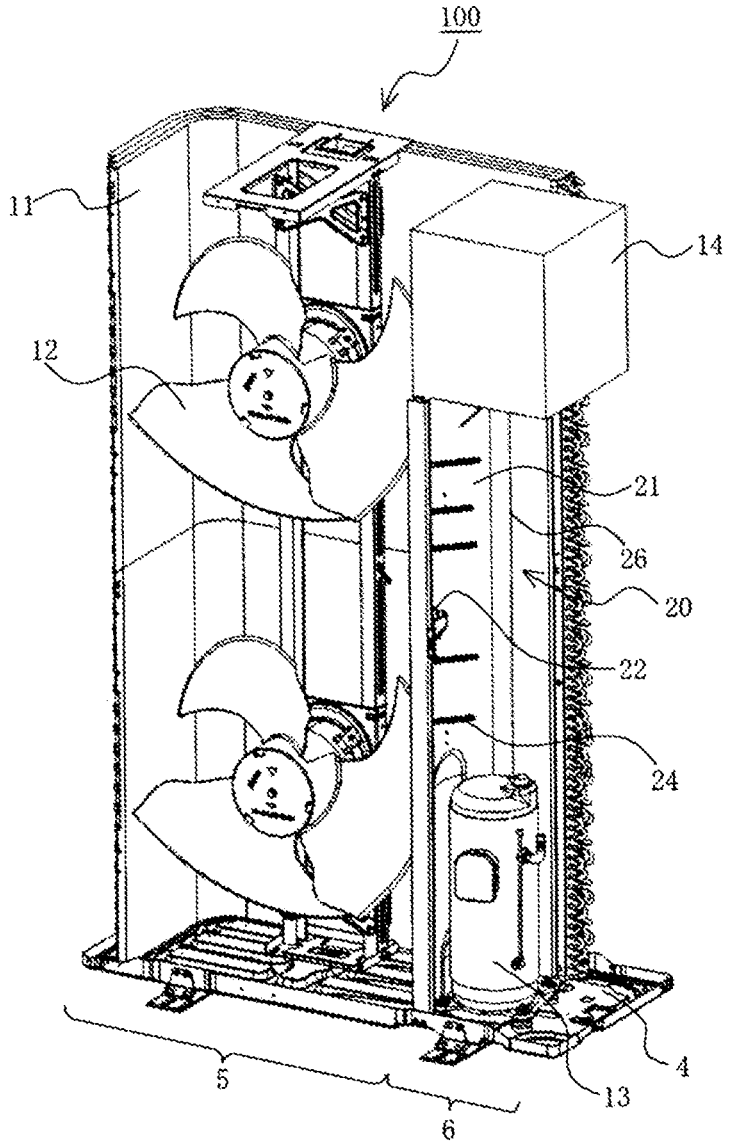
FIG. 2 is a perspective view showing an internal structure of the outdoor unit of the air-conditioning apparatus according to Embodiment.

FIG. 1 is a perspective view showing an external appearance of an outdoor unit of an air-conditioning apparatus according to Embodiment. FIG. 2 is a perspective view showing an internal structure of the outdoor unit of the air-conditioning apparatus according to Embodiment.

Hereinafter, an outdoor unit 100 will be described assuming that the side having air outlets 3 is the front surface side of the outdoor unit 100 of the air-conditioning apparatus. Therefore, FIG. 1 is a perspective view of the external appearance of the outdoor unit 100 as viewed from the front surface side, and FIG. 2 is a perspective view of the internal structure of the outdoor unit 100 as viewed from the front surface side.

The outdoor unit 100 of the air-conditioning apparatus includes a housing 1 having a substantially cuboid shape, for example. A front surface portion 2 of the housing 1 has the air outlets 3. The inside of the housing 1 is partitioned into a fan chamber 5 and a machine chamber 6 by a body portion 21 of a partition plate 20.

A heat exchanger 11 and fans 12 are accommodated in the fan chamber 5. The heat exchanger 11 is accommodated in the fan chamber 5 such that the heat exchanger 11 faces an air inlet formed at a portion of the housing 1, the portion forming the fan chamber 5. In Embodiment, the air inlet is formed extending from the back surface portion to the side surface portion of the housing 1. Therefore, the heat exchanger 11 has a substantially L shape as viewed in a plan view. The fans 12 are accommodated in the fan chamber 5 such that the fans 12 face the air outlets 3 formed at portions of the front surface portion 2 of the housing 1, the portions forming the fan chamber 5. In Embodiment, two fans 12 are accommodated in the fan chamber 5. Therefore, the front surface portion 2 of the housing 1 has two air outlets 3. In the outdoor unit 100 having such a configuration, when the fans 12 are driven, outdoor air is suctioned into the fan chamber 5 from the air inlet of the housing 1. At this point of operation, air suctioned into the fan chamber 5 exchanges heat with the heat exchanger 11. Air subjected to heat exchange with the heat exchanger 11 is blown out to the outside of the housing 1 from the air outlets 3.

An electric component box 14 is accommodated in the upper portion of the machine chamber 6. Electric parts, such as a control board, are accommodated in the electric component box 14. A device to be energized from the electric part in the electric component box 14 via a wiring is accommodated in the machine chamber 6 at a position below the electric component box 14. The device to be energized may be a compressor 13, for example.

In the same manner as the compressor 13, the fans 12 are also connected with the electric part in the electric component box 14 via a wiring, and the fans 12 are driven when the fans 12 are energized from the electric part in the electric component box 14. As described above, the fans 12 are accommodated in the fan chamber 5, and the electric component box 14 is accommodated in the machine chamber 6. Therefore, the body portion 21 of the partition plate 20, which partitions the inside of the housing 1 into the fan chamber 5 and the machine chamber 6, has a wiring passage 22 through which the wiring connected with the fans 12 passes. The wiring passage 22 may be a through hole or a groove, for example. In Embodiment, the wiring passage 22 is a through hole having a circular shape.

As described above, the air outlets 3 are formed at the portions of the housing 1, the portions forming the fan chamber 5. Therefore, water, such as rain, intrudes into the fan chamber 5 from the air outlet 3. Accordingly, there is a possibility that water having intruded into the fan chamber 5 intrudes into the machine chamber 6 through the wiring passage 22, which is formed in the body portion 21 of the partition plate 20, and the water adheres to the device to be energized, such as the compressor 13, that is provided below the electric component box 14. Therefore, the outdoor unit 100 according to Embodiment has the following configuration to prevent adhesion of water to the device to be energized, such as the compressor 13, that is provided below the electric component box 14.

Figure 3:
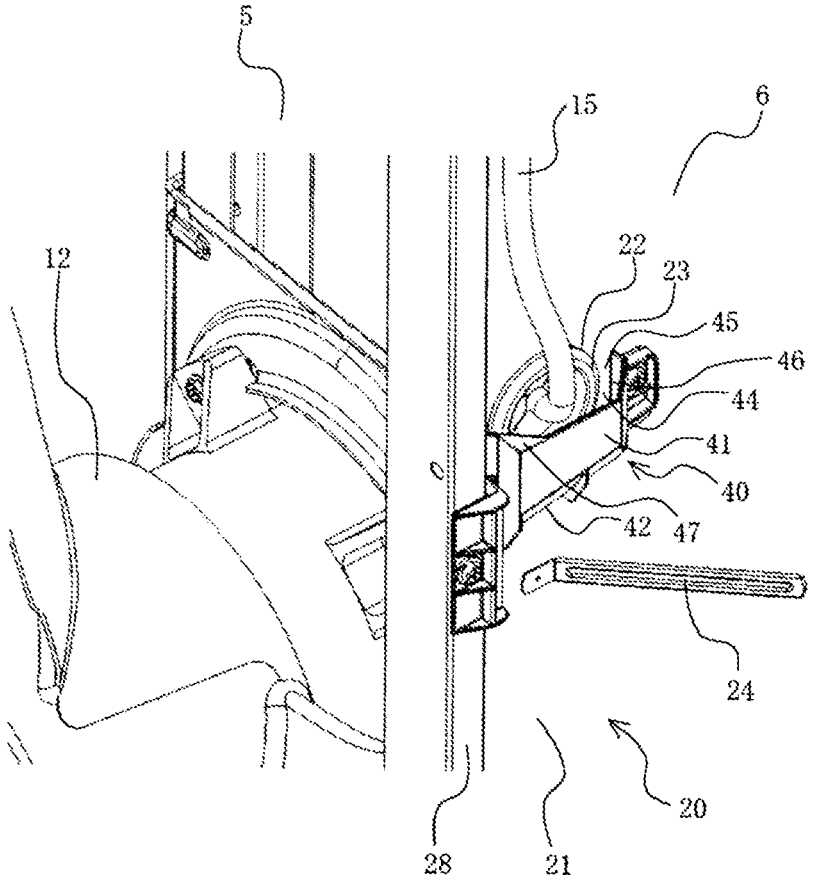
FIG. 3 is a perspective view of an area around a wiring passage of the outdoor unit of the air-conditioning apparatus according to Embodiment as viewed from the front side.
Figure 4:
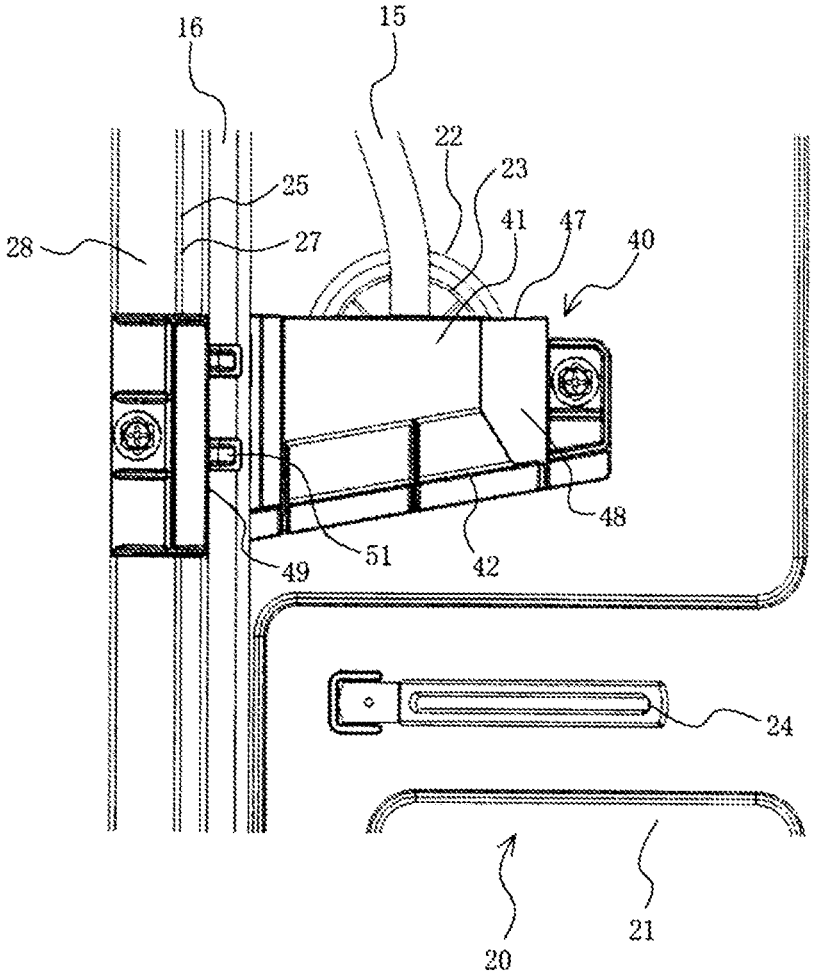
FIG. 4 is a side view of the area around the wiring passage of the outdoor unit of the air-conditioning apparatus according to Embodiment.
Figure 5:
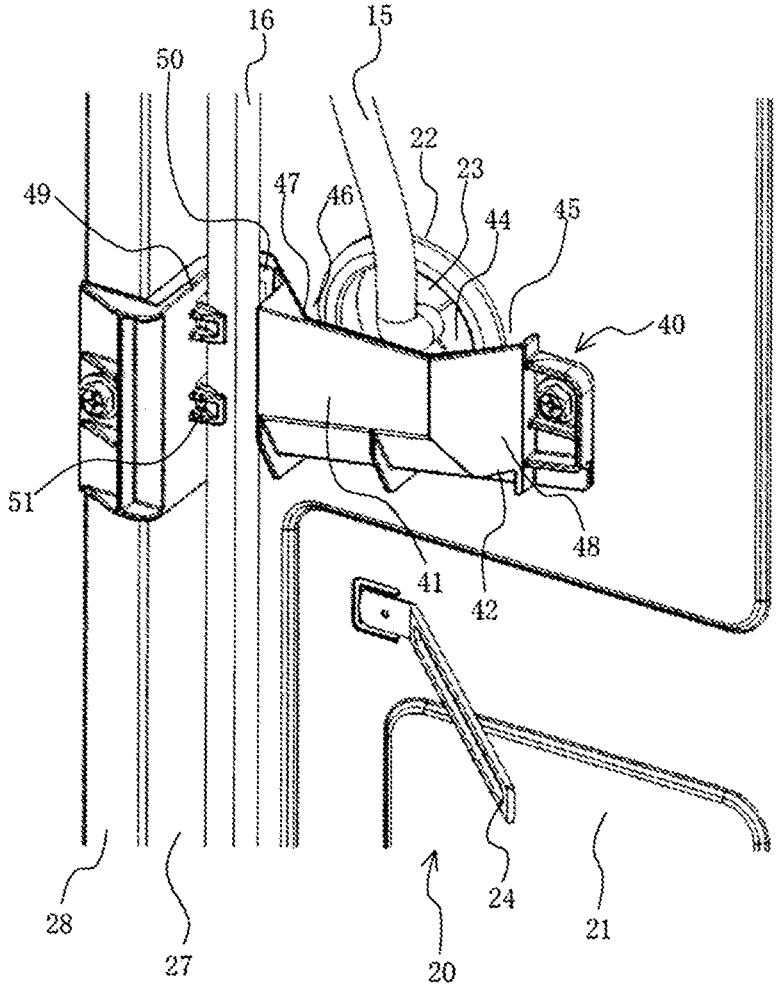
FIG. 5 is a perspective view of the area around the wiring passage of the outdoor unit of the air-conditioning apparatus according to Embodiment as viewed from the back side.

FIG. 3 is a perspective view of an area around the wiring passage of the outdoor unit of the air-conditioning apparatus according to Embodiment as viewed from the front side. FIG. 4 is a side view of the area around the wiring passage of the outdoor unit of the air-conditioning apparatus according to Embodiment. FIG. 5 is a perspective view of the area around the wiring passage of the outdoor unit of the air-conditioning apparatus according to Embodiment as viewed from the back side. Further, FIG. 6 is a transverse cross-sectional view of the area around the wiring passage of the outdoor unit of the air-conditioning apparatus according to Embodiment.

Figure 6:
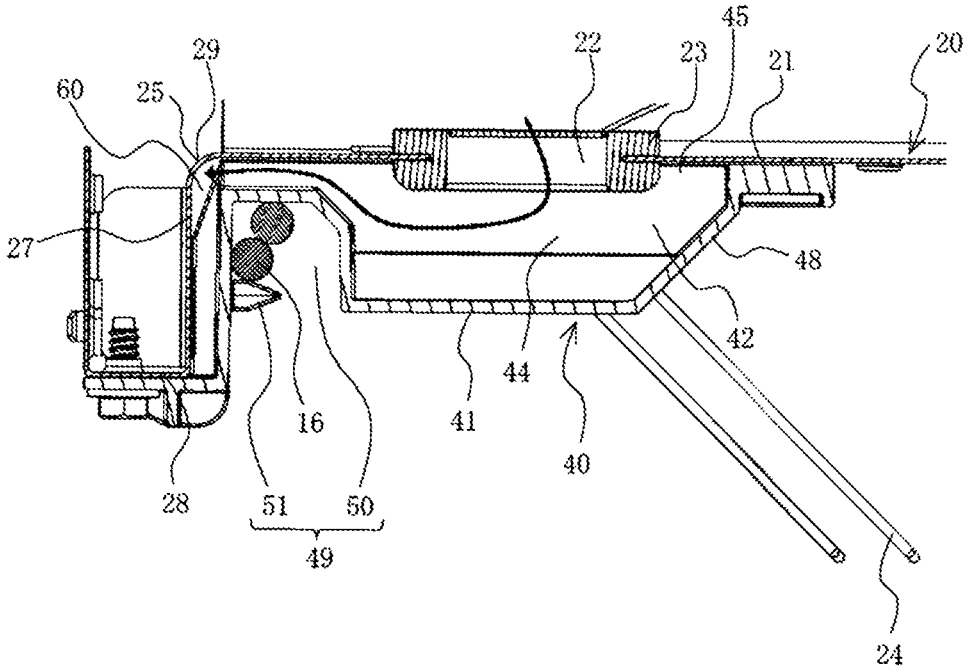
FIG. 6 is a transverse cross-sectional view of the area around the wiring passage of the outdoor unit of the air-conditioning apparatus according to Embodiment.

A bold arrow shown in FIG. 6 shows the flow of water in a water receiving part 40. A wiring 15 shown in FIG. 3 to FIG. 5 shows the wiring connected to the fans 12. Further, a wiring 16 shown in FIG. 4 to FIG. 6 shows the wiring connected with the device to be energized that is disposed in the machine chamber 6 at a position below the electric component box 14. For example, the wiring 16 may be the wiring connected to the compressor 13.

As described above, in Embodiment, the wiring passage 22 is a through hole having a circular shape. A rubber bush 23 is fitted in the wiring passage 22. The rubber bush 23 is a rubber part that covers the wiring passage 22, and has a cross-shaped cut at the center portion of the rubber bush 23. The wiring 15 connected to the fans 12 is routed to the machine chamber 6 from the fan chamber 5 through this cut. The wiring passage of a related-art outdoor unit is also provided with a rubber bush. In the related-art outdoor unit, such a rubber bush is provided to prevent water having intruded into the fan chamber from intruding into the machine chamber 6 through the wiring passage. However, when the wiring 15 is inserted into the cut formed in the rubber bush 23, a gap is formed at a portion where the cut is formed. Further, when a plurality of wirings 15 are inserted into the cut formed in the rubber bush 23, gaps are also formed between the wirings 15. Therefore, even when the rubber bush 23 is provided to the wiring passage 22, water intrudes into the machine chamber 6 from the wiring passage 22 and splashes, so that the water adheres to the device accommodated in the machine chamber 6.

In view of the above, the outdoor unit 100 according to Embodiment includes the box-shaped water receiving part 40 that receives water intruding into the machine chamber 6 from the wiring passage 22. The water receiving part 40 is provided to the machine chamber 6 such that a side wall portion 41 of the water receiving part 40 faces the wiring passage 22. That is, a bottom portion 42 of the water receiving part 40 is disposed at a position lower than the wiring passage 22. The side wall portion 41 of the water receiving part 40 has a first opening port 45 at a portion that faces the wiring passage 22. In Embodiment, the entire portion of the side wall portion 41 that faces the body portion 21 of the partition plate 20 having the wiring passage 22 forms the first opening port 45. An upper surface portion 47 of the water receiving part 40 has a second opening port 46 through which the wiring 15 drawn from the water receiving part 40 passes. That is, the wiring 15 routed into the water receiving part 40 from the wiring passage 22 is bent upward, is routed to the outside of the water receiving part 40 from the second opening port 46, and is connected with the electric part in the electric component box 14.

The water receiving part 40 having the above-mentioned configuration is attached to the partition plate 20 such that the peripheral edge of the first opening port 45 is brought into contact with the body portion 21 of the partition plate 20. In other words, the water receiving part 40 is attached to the partition plate 20 such that the peripheral edge of the first opening port 45 is brought into contact with a portion of the body portion 21 that forms the outer periphery of the wiring passage 22. Further, in the state where the water receiving part 40 is attached to the partition plate 20, a gap 60 is formed between a portion of the bottom portion 42 of the water receiving part 40 and the partition plate 20, water received by the water receiving part 40 passing through the gap 60 when discharged from the water receiving part 40. Further, the bottom portion 42 is inclined toward the gap 60.

Therefore, water having intruded into the machine chamber 6 from the gap between the rubber bush 23 and the wiring 15, for example, is received by a recess 44 formed by the side wall portion 41 of the water receiving part 40 and the bottom portion 42. Further, the wiring 15 is routed upward in the water receiving part 40 and hence, water having intruded into the machine chamber 6 along the wiring 15 is also received by the recess 44. That is, water having intruded into the machine chamber 6 from the wiring passage 22 is received by the recess 44 of the water receiving part 40, As shown in FIG. 6, the water received by the recess 44 flows along the inclined bottom portion 42 toward the gap 60, and is discharged to the outside of the water receiving part 40 from the gap 60. Further, the gap 60 is formed between a portion of the bottom portion 42 of the water receiving part 40 and the partition plate 20 and hence, water discharged to the outside of the water receiving part 40 from the gap 60 flows downward along the partition plate 20. The water that flows downward along the partition plate 20 is received by a bottom plate 4, forming the bottom surface portion of the housing 1, and is discharged to the outside of the outdoor unit 100 from a drain port not shown in the drawing formed in the bottom plate 4.

In the outdoor unit 100 including the water receiving part 40, water having intruded into the machine chamber 6 from the wiring passage 22 can be discharged as described above and hence, it is possible to prevent water having intruded into the machine chamber 6 from the wiring passage 22 from splashing in the machine chamber 6, whereby it is possible to prevent adhesion of water to the device to be energized, such as the compressor 13, that is provided below the electric component box 14. Further, the upper surface portion 47 of the water receiving part 40 has the second opening port 46 through which the wiring 15 drawn from the water receiving part 40 passes and hence, it is also possible to obtain an advantageous effect that routing of the wiring 15 is facilitated.

In Embodiment, the gap 60 is formed in the bottom portion 42 at the lowest position. Therefore, all water received by the recess 44 can be discharged to the outside of the water receiving part 40.

In Embodiment, the wiring passage 22 is a through hole having a circular shape. The upper surface portion 47 of the water receiving part 40 is disposed at a position higher than the center of the through hole that forms the wiring passage 22. That is, the side wall portion 41 of the water receiving part 40 covers not only a position lower than the center of the through hole that forms the wiring passage 22, but also a position higher than the center of the through hole that forms the wiring passage 22. In the case where the wiring passage 22 is a through hole having a circular shape, a rubber bush 9 is attached as described above. In general, the wiring 15 is caused to pass through the cut formed at the center portion of the rubber bush 23. Therefore, a gap is likely to be formed in the vicinity of the center of the through hole that forms the wiring passage 22 and hence, water easily intrudes into the machine chamber 6 from the vicinity of the center of the through hole. The upper surface portion 47 of the water receiving part 40 is disposed at a position higher than the center of the through hole that forms the wiring passage 22 and hence, compared with the case where the upper surface portion 47 of the water receiving part 40 is disposed at a position lower than the center of the through hole that forms the wiring passage 22, water having intruded into the machine chamber 6 from the wiring passage 22 can be received by the recess 44 of the water receiving part 40 with more certainty. That is, the upper surface portion 47 of the water receiving part 40 is disposed at a position higher than the center of the through hole that forms the wiring passage 22 and hence, compared with the case where the upper surface portion 47 of the water receiving part 40 is disposed at a position lower than the center of the through hole that forms the wiring passage 22, it is possible to more reliably prevent adhesion of water to the device to be energized, such as the compressor 13, that is provided below the electric component box 14.

Further, in Embodiment, the water receiving part 40 is attached to the partition plate 20 as described below and hence, the water receiving part 40 can be easily attached. First, in describing the configuration for attaching the water receiving part 40 to the partition plate 20, one of the end portions of the body portion 21 of the partition plate 20 in the horizontal direction is named as a first end portion 25. Further, the other of the end portions of the body portion 21 of the partition plate 20 in the horizontal direction is named as a second end portion 26. As shown in FIG. 2, in Embodiment, the body portion 21 of the partition plate 20 extends in the longitudinal direction to partition the inside of the housing 1 into the fan chamber 5 and the machine chamber 6. Therefore, the body portion 21 has a front end portion and a rear end portion as the end portions in the horizontal direction. Accordingly, in Embodiment, one of the front end portion and the rear end portion of the body portion 21 is the first end portion 25, and the other of the front end portion and the rear end portion of the body portion 21 is the second end portion 26. Hereinafter, as shown in FIG. 2 and FIG. 6, the configuration for attaching the water receiving part 40 to the partition plate 20 will be described assuming that the front end portion of the body portion 21 is named as the first end portion 25, and the rear end portion of the body portion 21 is named as the second end portion 26.

The partition plate 20 includes a bent portion 27 that extends to the opposite side of the fan chamber 5 from the first end portion 25 of the body portion 21. The water receiving part 40 is attached in a state where the water receiving part 40 is brought into contact with the body portion 21 and the bent portion 27. When the water receiving part 40 is attached to the partition plate 20, by causing the water receiving part 40 to be brought into contact with the body portion 21 and the bent portion 27, the water receiving part 40 can be positioned in the horizontal direction. Therefore, the water receiving part 40 can be easily positioned at the attachment position and hence, the water receiving part 40 can be easily attached.

A method for fixing the water receiving part 40 to the partition plate 20 is not particularly limited. However, in Embodiment, the water receiving part 40 is fixed to the partition plate 20 by fixing the front end portion and the rear end portion of the water receiving part 40 to the partition plate 20 by screws. Specifically, a second bent portion 28 extending parallel to the body portion 21 is connected to the end portion of the bent portion 27 of the partition plate 20 on the opposite side of the end portion connected with the body portion 21. The front end portion of the water receiving part 40 is fixed to the second bent portion 28 by a screw. The rear end portion of the water receiving part 40 is also fixed to the body portion 21 by a screw.

In Embodiment, in the state where the water receiving part 40 is attached and in contact with the body portion 21 and the bent portion 27, the gap 60 is formed at a corner portion 29, which is a portion where the body portion 21 and the bent portion 27 are connected with each other. Therefore, when water discharged to the outside of the water receiving part 40 from the gap 60 flows downward along the partition plate 20, the water flows through the corner portion 29. Water discharged to the outside of the water receiving part 40 flows through the corner portion 29 and hence, compared with the case where water discharged to the outside of the water receiving part 40 flows along the planar portion of the partition plate 20, it is possible to more reliably prevent water flowing downward along the partition plate 20 from spreading out and splashing. Therefore, water discharged to the outside of the water receiving part 40 flows through the corner portion 29 and hence, compared with the case where water discharged to the outside of the water receiving part 40 flows through the planar portion of the partition plate 20, it is possible to more reliably prevent adhesion of water to the device to be energized, such as the compressor 13, that is provided below the electric component box 14.

In Embodiment, the separation between the wiring passage 22 and the first end portion 25 of the body portion 21 is smaller than the separation between the wiring passage 22 and the second end portion 26 of the body portion 21. That is, the wiring passage 22 is disposed in the vicinity of the bent portion 27. With such a configuration, in the case where the water receiving part 40 is attached in a state of being brought into contact with the body portion 21 and the bent portion 27, and the gap 60 is formed at the corner portion 29, the separation from the wiring passage 22 to the gap 60 as viewed in a plan view can be reduced. Accordingly, it is possible to rapidly discharge water having intruded into the machine chamber 6 and received by the water receiving part 40 to the outside of the outdoor unit 100.

Further, in Embodiment, the water receiving part 40 includes an inclined portion 48 at a portion of the side wall portion 41, The inclined portion 48 is connected with a portion of the bottom portion 42 that is disposed at a position higher than the gap 60. Further, as viewed in a plan view, the inclined portion 48 has a shape where the inclined portion 48 approaches the body portion 21 of the partition plate 20 as the separation of the inclined portion 48 from the gap 60 increases. In other words, as viewed in a plan view, a portion of the side wall portion 41 that is connected with a portion of the bottom portion 42 that is disposed at a position higher than the gap 60 has a shape where the portion of the side wall portion 41 approaches the body portion 21 of the partition plate 20 as the separation of the portion of the side wall portion 41 from the gap 60 increases. The water receiving part 40 includes the inclined portion 48 and hence, it is possible to reduce the area of the portion of the bottom portion 42 that is disposed at a position higher than the gap 60. Therefore, with the configuration where the water receiving part 40 includes the inclined portion 48, it is possible to shorten a time period during which water stays in the water receiving part 40. Accordingly, it is possible to rapidly discharge water having intruded into the machine chamber 6 and received by the water receiving part 40 to the outside of the outdoor unit 100.

Further, in Embodiment, the water receiving part 40 includes a wiring fixing portion 49 that fixes the wiring 16. In Embodiment, the wiring fixing portion 49 includes a recessed portion 50, and claws 51 provided such that the claws 51 partially close the opening port of the recessed portion 50. The wiring 16 is fixed in such a manner that the wiring 16 is sandwiched between the peripheral wall of the recessed portion 50 and the claws 51. The wiring fixing portion 49 is provided at an outer portion of the water receiving part 40 that has no water discharging function.

The wiring 16 connected with the device to be energized, such as the compressor 13, that is provided below the machine chamber 6 is routed upward, and is connected with the electric part in the electric component box 14. In connecting the wiring 16 with the electric part, by fixing the wiring 16 with the wiring fixing portion 49, the wiring 16 can be disposed in a state of being displaced from a path through which water discharged from the water receiving part 40 passes. With such a configuration, it is possible to prevent water discharged from the water receiving part 40 from reaching the device to be energized, such as the compressor 13, along the wiring 16. The body portion 21 of the partition plate 20 is also provided with a fixture 24 for fixing the wiring 16. In Embodiment, the wiring 16 can be fixed also by the fixture 24 in a state of being displaced from the path through which water discharged from the water receiving part 40 passes.

As has been described above, the outdoor unit 100 of the air-conditioning apparatus according to Embodiment includes the housing 1, and the partition plate 20 including the body portion 21 that partitions the inside of the housing 1 into the machine chamber 6 and the fan chamber 5, the device to be energized being accommodated in the machine chamber 6, the fans 12 being accommodated in the fan chamber 5. The body portion 21 of the partition plate 20 has the wiring passage 22 through which the wiring 15 connected with the fans 12 passes. The outdoor unit 100 also includes the water receiving part 40 provided to the machine chamber 6, with the side wall portion 41 facing the wiring passage 22, to receive water intruding into the machine chamber 6 from the wiring passage 22, the water receiving part 40 having a box shape. The side wall portion 41 of the water receiving part 40 has the first opening port 45 at a portion that faces the wiring passage 22, and the upper surface portion 47 of the water receiving part 40 has the second opening port 46 through which the wiring 15 drawn from the water receiving part 40 passes. The water receiving part 40 is attached to the partition plate 20 such that the peripheral edge of the first opening port 45 is brought into contact with the body portion 21. The gap 60 is formed between a portion of the bottom portion 42 of the water receiving part 40 and the partition plate 20, water received by the water receiving part 40 passing through the gap 60 when discharged from the water receiving part 40. Further, the bottom portion 42 is inclined toward the gap 60.

In the outdoor unit 100 of the air-conditioning apparatus according to Embodiment, water having intruded into the machine chamber 6 from the wiring passage 22 of the partition plate 20 is received by the water receiving part 40. In the outdoor unit 100 of the air-conditioning apparatus according to Embodiment, water received by the water receiving part 40 flows downward along the partition plate 20. Therefore, in the outdoor unit 100 of the air-conditioning apparatus according to Embodiment, it is possible to prevent adhesion of water to the device to be energized that is provided below the electric component box 14.

REFERENCE SIGNS LIST

1: housing, 2: front surface portion, 3: air outlet, 4: bottom plate, 5: fan chamber, 6: machine chamber, 11: heat exchanger, 12: fan, 13: compressor, 14: electric component box, 15: wiring, 16: wiring, 20: partition plate, 21: body portion, 22: wiring passage, 23: rubber bush, 24: fixture, 25: first end portion, 26: second end portion, 27: bent portion, 28: second bent portion, 29: corner portion, 40: water receiving part, 41: side wall portion, 42: bottom portion, 44: recess, 45: first opening port, 46: second opening port, 47: upper surface portion, 48: inclined portion, 49: wiring fixing portion, 50: recessed portion, 51: claw, 60: gap, 100: outdoor unit.

The invention claimed is:

1. An outdoor unit of an air-conditioning apparatus, the outdoor unit comprising:

a housing; and a partition plate including a body portion configured to partition an inside of the housing into a machine chamber and a fan chamber, a device to be energized being accommodated in the machine chamber, a fan being accommodated in the fan chamber, the body portion of the partition plate having a wiring passage through which a wiring connected with the fan passes, wherein the outdoor unit includes a water receiving part provided to the machine chamber, with a side wall portion of the water receiving part facing the wiring passage, to receive water intruding into the machine chamber from the wiring passage, the water receiving part having a box shape, the side wall portion of the water receiving part has a first opening port at a portion that faces the wiring passage, and an upper surface portion of the water receiving part has a second opening port through which the wiring drawn from the water receiving part passes, the water receiving part is attached to the partition plate such that a peripheral edge of the first opening port is brought into contact with the body portion, a gap is formed between a portion of a bottom portion of the water receiving part and the partition plate, water received by the water receiving part passing through the gap when discharged from the water receiving part, and the bottom portion is inclined toward the gap.

2. The outdoor unit of an air-conditioning apparatus of claim 1, wherein the gap is formed in the bottom portion at a lowest position.

3. The outdoor unit of an air-conditioning apparatus of claim 1, wherein the wiring passage is a through hole having a circular shape, and the upper surface portion of the water receiving part is disposed at a position higher than a center of the through hole.

4. The outdoor unit of an air-conditioning apparatus of any one of claim 1, wherein, the partition plate includes a bent portion that extends to a side of the fan chamber opposite from a first end portion being one of end portions of the body portion in a horizontal direction, and the water receiving part is attached in a state of being brought into contact with the body portion and the bent portion.

5. The outdoor unit of an air-conditioning apparatus of claim 4, wherein the gap is formed at a corner portion where the body portion and the bent portion are connected with each other.

6. The outdoor unit of an air-conditioning apparatus of claim 5, wherein, of the end portions of the body portion in the horizontal direction, an end portion on an opposite side of the first end portion is a second end portion, and a separation between the wiring passage and the first end portion is smaller than a separation between the wiring passage and the second end portion.

7. The outdoor unit of an air-conditioning apparatus of claim 1, wherein a portion of the side wall portion that is connected with a portion of the bottom portion that is disposed at a position higher than the gap has a shape where, as viewed in a plan view, the portion of the side wall portion approaches the body portion of the partition plate as a separation of the portion of the side wall portion from the gap increases.

8. The outdoor unit of an air-conditioning apparatus of claim 1, wherein the water receiving part includes a wiring fixing portion that fixes a wiring.

* * * * *